US012606278B2

(12) United States Patent
Chen et al.

(10) Patent No.: US 12,606,278 B2
(45) Date of Patent: Apr. 21, 2026

(54) OFFSHORE FLOATING-TYPE WIND POWER COMBINED SEMI-SUBMERSIBLE PLATFORM FOUNDATION

(71) Applicant: WISON NEW ENERGIES CO., LTD., Nantong (CN)

(72) Inventors: Weimin Chen, Katy, TX (US); Xujie Pan, Nantong (CN); Ge Wang, Houston, TX (US); Fubin Liu, Nantong (CN); Zhichao Fang, Nantong (CN); Zhiqing Zhou, Nantong (CN); Wenlu Zhang, Nantong (CN); Zibiao Fang, Nantong (CN)

(73) Assignee: WISON NEW ENERGIES CO., LTD., Nantong (CN)

( * ) Notice: Subject to any disclaimer, the term of this patent is extended or adjusted under 35 U.S.C. 154(b) by 439 days.

(21) Appl. No.: 18/026,597

(22) PCT Filed: Mar. 18, 2022

(86) PCT No.: PCT/CN2022/081659
§ 371 (c)(1),
(2) Date: Mar. 16, 2023

(87) PCT Pub. No.: WO2022/199477
PCT Pub. Date: Sep. 29, 2022

(65) Prior Publication Data

US 2023/0331355 A1 Oct. 19, 2023

(30) Foreign Application Priority Data

Mar. 23, 2021 (CN) ..... 202120586901.9

(51) Int. Cl.
*B63B 35/44* (2006.01)
*B63B 1/10* (2006.01)

(52) U.S. Cl.
CPC ..... *B63B 35/44* (2013.01); *B63B 1/107* (2013.01); *B63B 2035/446* (2013.01)

(58) Field of Classification Search
CPC .... B63B 35/44; B63B 1/107; B63B 2035/446
See application file for complete search history.

(56) References Cited

U.S. PATENT DOCUMENTS 7,854,570 B2 * 12/2010 Heidari ..... B63B 1/107 405/224.2
2019/0367136 A1 12/2019 Nass et al.
2023/0407844 A1 * 12/2023 Kant ..... E02D 27/425

FOREIGN PATENT DOCUMENTS

CN 103373439 A 10/2013
CN 107709151 A 2/2018
(Continued)

*Primary Examiner* — S. Joseph Morano
*Assistant Examiner* — Jovon E Hayes
(74) *Attorney, Agent, or Firm* — Bayramoglu Law Offices LLC

(57) ABSTRACT

An offshore floating-type wind power combined semi-submersible platform foundation has at least three stand columns that form an enclosure having a polygonal structure. The adjacent stand columns are connected by an upper support and a lower support. Each stand column is composed of an upper column body and a lower column body that are arranged coaxially. An upper portion of the upper column body is provided with a support block, the upper support rests on the support block. A lower portion of the upper column body is provided with a lower support connecting portion that is connected to the lower support. With the structural form of the offshore floating-type wind power combined semi-submersible platform foundation, the requirements for a manufacturing site and a combination site are greatly reduced, providing the possibility of large-scale offsite construction.

11 Claims, 3 Drawing Sheets

(56) References Cited

FOREIGN PATENT DOCUMENTS

| | | | | | |
|---|---|---|---|---|---|
| CN | 214493276 | U | * | 10/2021 | ..... B63B 73/43 |
| GB | 2459904 | A | * | 11/2009 | ..... B63B 35/44 |
| JP | 2010280301 | A | | 12/2010 | |
| JP | 5190329 | B2 | * | 4/2013 | ..... B63B 1/125 |
| KR | 20170113793 | A | | 10/2017 | |
| WO | 2020167137 | A1 | | 8/2020 | |

* cited by examiner

OFFSHORE FLOATING-TYPE WIND POWER COMBINED SEMI-SUBMERSIBLE PLATFORM FOUNDATION

CROSS-REFERENCE TO THE RELATED APPLICATIONS

This application is the national phase entry of International Application No. PCT/CN2022/081659, filed on Mar. 18, 2022, which is based upon and claims priority to Chinese Patent Application No. 202120586901.9, filed on Mar. 23, 2021, the entire contents of which are incorporated herein by reference.

TECHNICAL FIELD

The present invention relates to an offshore wind power foundation, and in particular, to an offshore floating-type wind power combined sub-submersible platform foundation.

BACKGROUND

Offshore wind power develops towards high power and gradual deepening in the future. Floating-type wind power will gradually become a mainstream of the offshore wind power. A semi-submersible manner adopted is a most reliable foundation form of the floating-type wind power. However, with an increasingly high power of a wind generator, a semi-submersible size needs to be continuously increased to resist a wind tilting moment. As a result, an extremely high requirement is put forward on a final construction site, either with a large dock or a heavy-duty track that matches a semi-submersible barge for launching. As the large dock and the heavy-duty rail are both scarce resources, large-scale and quick development of the floating-type wind power is greatly limited.

SUMMARY

The present invention aims to solve the technical problem about how to implement manufacturing and launching of a semi-submersible platform without a large dock and a launching way.

To solve the technical problem, an offshore floating-type wind power combined semi-submersible platform foundation provided in the present invention includes at least three stand columns. The stand columns are enclosed into a polygonal structure. Adjacent stand columns are connected by using an upper support and a lower support. The stand column includes an upper column body and a lower column body. The upper column body and the lower column body are coaxially disposed. A support block is disposed on an upper part of the upper column body. The upper support is put on the support block. A lower support connection part is disposed on a lower part of the upper column body, and the lower support connection part is connected to the lower support.

According to the technical solution, a bump is disposed at a front end of the support block, and the upper support is put on the bump.

According to the technical solution, a front end of the lower support connection part exceeds an outer edge of the lower column body. A support plate is disposed on a lower side at the front end of the lower support connection part. The support plate is fastened to the front end of the lower support connection part through a ring-shaped buckle, and the lower support is put on the support plate.

According to the technical solution, the stand columns are enclosed into a triangular or quadrangular structure.

According to the technical solution, the lower support connection part is disposed on an upper top surface of the lower column body.

According to the technical solution, the upper support and the lower support are both strip-shaped beams.

According to the technical solution, a hollow-out hole is provided in the support plate, and the hollow-out hole is provided at a joint of the lower support connection part and the lower support.

According to an installation method of an offshore floating-type wind power combined semi-submersible platform foundation disclosed in the present invention, construction of an upper support, a lower support and a stand column are accomplished on a production site. Two support blocks are welded on a same horizontal line on the upper part of the stand column, and an included angle of 60 degrees is formed between the support blocks. Two lower support connection parts are welded on a same horizontal line on the lower part of the stand column, and an included angle between the lower support connection parts is consistent with the included angle between the support blocks. The support blocks correspond to the lower support connection parts from top to bottom. A horizontal support plate is fixedly disposed at the front end of the lower support connection part through a ring-shaped buckle. The constructed stand column, upper support and lower support are transported by a transport ship to a wharf near a wind farm. On the wharf, two stand columns are put into water through a crane or a crawler crane. By controlling a relative distance between the stand columns, the two ends of the lower support are put on support plates of the two stand columns and are fastened to the lower support connection parts by welding. The two ends of the upper support are put on the corresponding support blocks and are fastened with the stand columns by welding. By repeating the steps, the stand columns form a polygonal structure.

According to the method, when there are even stand columns, the stand columns are first connected in pairs, and then, the connected stand columns are connected through the upper support and the lower support.

According to the solution, a concept of a combined semi-submersible platform is proposed. Based on a combined characteristic, a medium-sized module only needs to be constructed on the production site while a dock, a slipway and a wharf are not needed. In addition, manufacturing can be further implemented in a region with a low manufacturing cost. After being manufactured on the production site, a plurality of to-be-combined parts can be transported by a common transport ship to a wharf near an offshore wind farm. In this way, the wharf on the site does not need a dock/slipway, and semi-submersible combination can be accomplished by a crane with common crane capacity. With the implementation of the solution, it is possible to construct the offshore sub-submersible floating foundation for a high-power wind generator on a large scale.

DETAILED DESCRIPTION OF THE EMBODIMENTS

Figure 1:
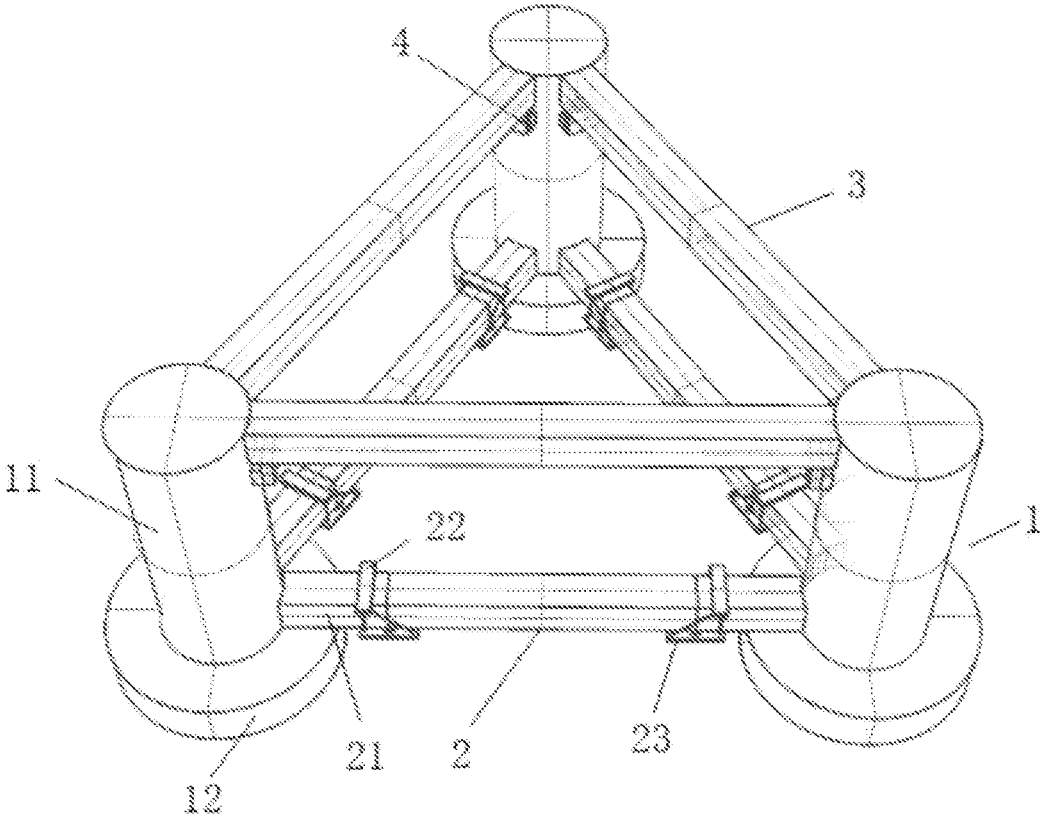
FIG. 1 is a schematic diagram of a structure of a three-stand-column combined type semi-submersible corrosion platform foundation.
Figure 2:
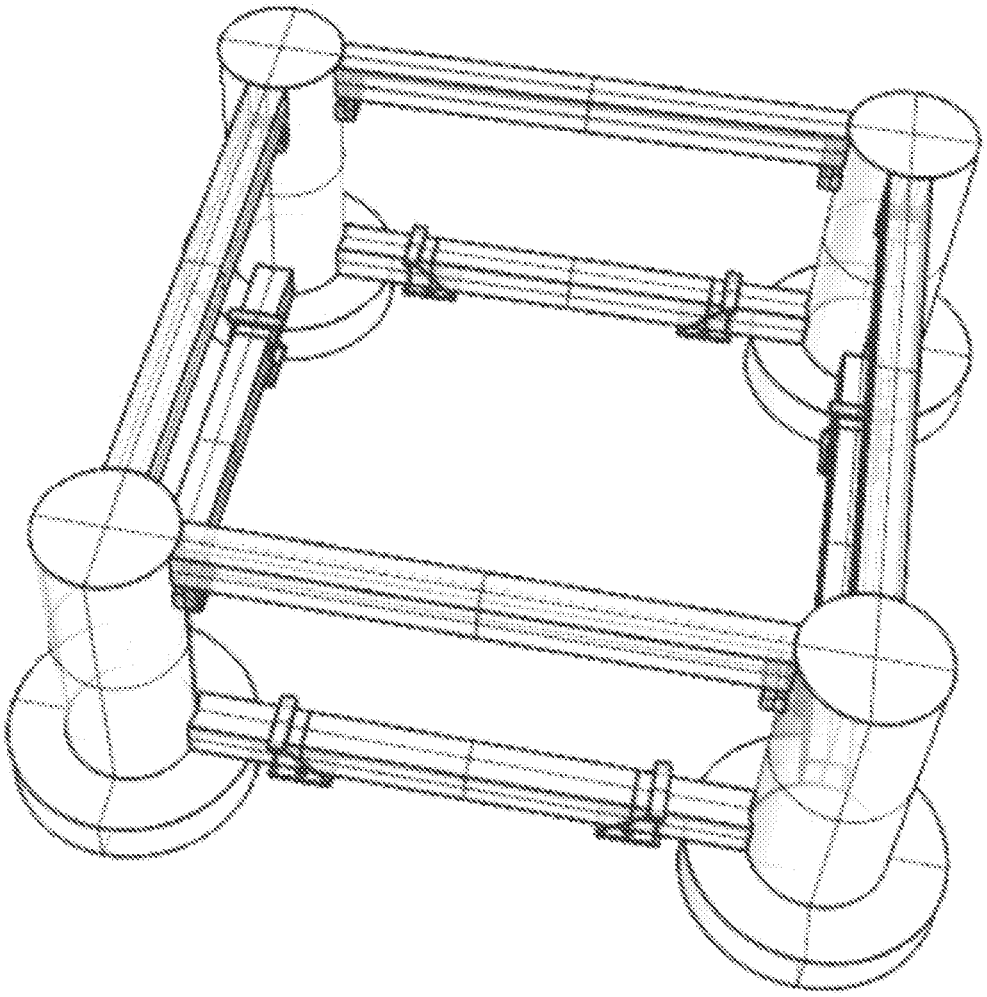
FIG. 2 is a schematic diagram of a structure of a four-stand-column combined type semi-submersible corrosion platform foundation.
Figure 3:
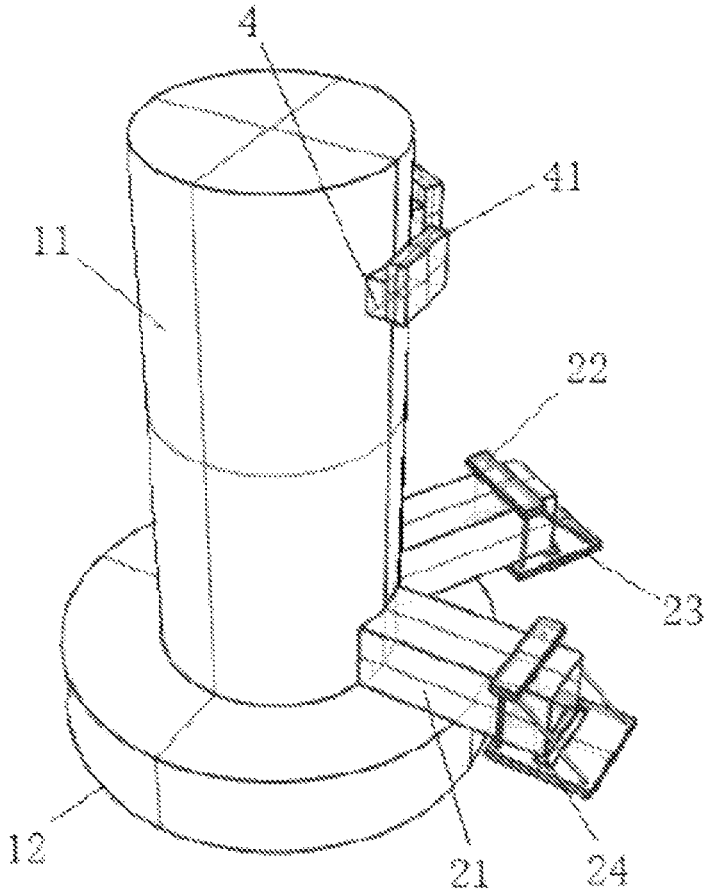
FIG. 3 is a schematic diagram of a structure of a stand column in which an assembly auxiliary part is disposed at an included angle of 60 degrees.

Refer to FIG. 1 to FIG. 3, an offshore floating-type wind power combined semi-submersible platform foundation provided in the present invention mainly includes stand columns 1 and a support structure. A combined semi-submersible platform foundation is preferably of a four-column type or a three-column type. Refer to FIG. 2, the four-column type mainly includes four stand columns 1, four lower supports 2, and four upper supports 3. Refer to FIG. 1, the three-column type mainly includes three stand columns 1, three lower supports 2, and three upper supports 3. The stand columns 1, the lower supports 2, the upper supports 3 and an assembly auxiliary part are constructed on a manufacturing site. The parts occupy less space, are convenient to transport, and can be constructed in a region with low labor cost.

The stand column 1 includes an upper column body 11 and a lower column body 12. A cross section of the upper column body may be circular or polygonal, and a cross section of the lower column body may be circular or polygonal. An area of the cross section of the upper column body is smaller than an area of the cross section of the lower column body. The upper column body 11 is fastened to the lower column body 12 by welding, and the upper column body 11 and the lower column body 12 are coaxially disposed. The upper column body 11 and the lower column body 12 are preferably cylindrical structures.

The upper support 3 is a strip-shaped structural beam, and a cross section of the upper support is circular or polygonal. To facilitate construction, the upper support 3 is commonly a strip-shaped structural beam with a rectangular cross section.

The lower support 2 is a strip-shaped structural beam, and a cross section of the lower support is circular or polygonal. To facilitate construction, the lower support 2 is commonly a strip-shaped structural beam with a rectangular cross section. Before combination, the lower support 2 needs to connect and fasten to the stand column 1 through a lower support connection part 21, a ring-shaped buckle 22, and a support plate 23. The section of the lower support connection part 21 matches the section of the lower support 2. The lower support connection part 21 is welded at a joint of the upper column 11 and the lower column body 12 in advance. After the combination, each stand column 1 is connected to the two lower supports 2, and two lower support connection parts 21 are welded on the stand column 1.

When the semi-submersible platform foundation is of the four-column type, an angle between the two lower support connection parts 21 that are welded with the joint of the upper column body 11 and the lower column body 12 is 90 degrees. When the semi-submersible platform foundation is of the three-column type, an angle between the two lower support connection parts 21 that are welded with the joint of the upper column body 11 and the lower column body 12 is 60 degrees.

A support block 4 is welded on the upper part of the upper column body 11, and a bump 41 is disposed at the front end of the support block 4. The support block 4 is configured to temporarily put the upper support 3, and is specifically used for welding between the upper support 3 and the upper column body 11. A portion that is of the bump 41 and that is configured to support a lower side surface of the end part of the upper support is slightly higher than a surface of the support block 4. Near a side surface of the upper column body 11, there is sufficient space for exposing a contact beam between the upper support 3 and the side surface of the upper column body 11 to facilitate welding.

The lower support connection part 21 is pre-welded at the joint of the lower part of the upper column body 11 and the lower column body 12. The specification of the lower support connection part 21 matches that of the lower support 2. The front end of the lower support connection part 21 extends the side of the lower column body 12. A ring-shaped buckle 22 is disposed at the front end of the lower support connection part 21. The support plate 23 is fastened to the lower side of the lower support connection part 21 through the ring-shaped buckle 22. The support plate partially exceeds the lower support connection part 21 for supporting the lower support 2. A hollow-out hole 24 is provided in the support plate 23, and the hollow-out hole 24 is provided, at a joint of the lower support connection part 21 and the lower support 2, of a workpiece for welding.

An implementation method of the offshore floating-type wind power combined semi-submersible platform foundation that is of a three-column-body or four-column-body structure is as follows:

1. The stand column 1, the upper support 3, the lower support 2 are constructed on a site A, and the support block 4 and the lower support connection part 21 are mounted on the stand column 1. The upper support 3 and the lower support 2 are rectangular strip-shaped beams, and are internally hollow structures, so that weight is reduced. During construction of the stand column 1, the upper column body 11 and the lower column body 12 are welded into a complete main body. The upper column body 11 and the lower column body 12 are internally hollow structures, and can be internally blocked, so that water is injected for attitude adjustment. Two support blocks 4 are welded on the upper part of the upper column body 11, and an included angle between the support blocks 4 is kept to be greater than 60 degrees. When a three-stand-column 1 form is adopted, the included angle is 60 degrees. When a four-stand-column 1 form is adopted, an included angle is 90 degrees. When a five-stand-column form is adopted, an included angle is 108 degrees, and so on. The support block 4 is used for lap joint of the upper support 3. On the lower part of the column body, namely the joint between the upper column body 11 and the lower column body 12, the lower support connection part 21 is pre-welded. After being welded, the lower support connection part 21 extends out from the lower column body 12. In addition, the ring-shaped buckle 22 and the support plate 23 are mounted on the lower support connection part 21 for lap joint of the lower support 2.

2. The constructed stand column 1, upper support 3, and lower support 2 are transported by a transport ship to a wharf near a wind farm, namely site B.

3. On the wharf of the site B, two column bodies 1 are put into water through a crane or a crawler crane. The column bodies 1 stably suspend under buoyancy force thereof. Under a simple mooring condition of the wharf, a relative distance between two column bodies is controlled. The two column bodies 1 are connected and fastened by the pre-constructed support block 4 and lower support connection part 21 through the upper support 3 and the lower support 2.

4. When the semi-submersible platform foundation is of the three-column-body structure, the last column body 1 is put into water through a crane/crawler crane, and the column body 1 is dragged to a proper position through a tugboat. The column body 1 is connected to the two constructed column bodies 1 by the pre-constructed support block 4 and lower support connection part 21 through the upper support 3 and the lower support 2. In this way, the semi-submersible platform foundation of the three-column-body structure is constructed on the site B.

5. When the semi-submersible platform foundation is of the four-column-body structure, step 3 is first repeated to accomplish construction of two groups of column bodies 1 connected in pairs. The two groups of column bodies connected in pairs are vertically arranged in water. An angle and a distance between the two groups of connected column bodies are controlled by simple mooring. The two groups of connected column bodies are arranged in parallel with a proper distance. Then, the two groups of column bodies connected in pairs are connected by the pre-constructed support block 4 and lower support connection part 21 through the upper support 3 and the lower support 2. In this way, the semi-submersible platform foundation of the four-column form is constructed on the site B.

What is claimed is:

1. An offshore floating wind power combined semi-submersible platform foundation, comprising at least three stand columns, wherein the at least three stand columns form an enclosure of a polygonal structure, adjacent stand columns of the at least three stand columns are connected by using an upper support and a lower support, the at least three stand columns comprises an upper column body and a lower column body, the upper column body and the lower column body are coaxially arranged, a support block is disposed on an upper part of the upper column body, the upper support is positioned on the support block, a lower support connection part is disposed on a lower part of the upper column body, the lower support connection part is connected to the lower support, a bump is disposed at a front end of the support block, and the upper support is positioned on the bump.

2. An offshore floating wind power combined semi-submersible platform foundation, comprising at least three stand columns, wherein the at least three stand columns form an enclosure of a polygonal structure, adjacent stand columns of the at least three stand columns are connected by using an upper support and a lower support, the at least three stand columns comprises an upper column body and a lower column body, the upper column body and the lower column body are coaxially arranged, a support block is disposed on an upper part of the upper column body, the upper support is positioned on the support block, a lower support connection part is disposed on a lower part of the upper column body, the lower support connection part is connected to the lower support, a front end of the lower support connection part extends beyond an outer edge of the lower column body, a support plate is disposed on a lower side at the front end of the lower support connection part, the support plate is fastened to the front end of the lower support connection part through a ring-shaped buckle, and the lower support is positioned on the support plate.

3. The offshore floating wind power combined semi-submersible platform foundation according to claim 1, wherein the at least three stand columns form an enclosure of a triangular or quadrangular structure.

4. The offshore floating wind power combined semi-submersible platform foundation according to claim 1, wherein the lower support connection part is disposed on an upper top surface of the lower column body.

5. The offshore floating wind power combined semi-submersible platform foundation according to claim 1, wherein the upper support and the lower support are both strip-shaped beams.

6. The offshore floating wind power combined semi-submersible platform foundation according to claim 1, wherein the upper column body, the lower column body, the upper support, and the lower support are internally hollow structures.

7. The offshore floating wind power combined semi-submersible platform foundation according to claim 2, wherein a hollow-out hole is provided in the support plate, and a joint of the lower support connection part and the lower support is positioned at the hollow-out hole.

8. The offshore floating wind power combined semi-submersible platform foundation according to claim 2, wherein the at least three stand columns form an enclosure of a triangular or quadrangular structure.

9. The offshore floating wind power combined semi-submersible platform foundation according to claim 2, wherein the lower support connection part is disposed on an upper top surface of the lower column body.

10. The offshore floating wind power combined semi-submersible platform foundation according to claim 2, wherein the upper support and the lower support are both strip-shaped beams.

11. The offshore floating wind power combined semi-submersible platform foundation according to claim 2, wherein the upper column body, the lower column body, the upper support, and the lower support are internally hollow structures.

* * * * *